US007055178B2

(12) United States Patent
Gottlieb

(10) Patent No.: US 7,055,178 B2
(45) Date of Patent: Jun. 6, 2006

(54) SLEEVED GLOVE WITH LATCHING MECHANISM FOR AERODYNAMIC POSITION WHEN CYCLING

(76) Inventor: Edward A. Gottlieb, 2530 NE. 208 Ter., North Miami Beach, FL (US) 33180

( * ) Notice: Subject to any disclaimer, the term of this patent is extended or adjusted under 35 U.S.C. 154(b) by 65 days.

(21) Appl. No.: 10/805,211

(22) Filed: Mar. 22, 2004

(65) Prior Publication Data

US 2005/0204453 A1 Sep. 22, 2005

(51) Int. Cl.
*A41D 19/00* (2006.01)

(52) U.S. Cl. ..... 2/161.1; 2/160

(58) Field of Classification Search ..... 2/161.1, 2/161.6, 162, 170, 16, 17, 69, 160
See application file for complete search history.

(56) References Cited

U.S. PATENT DOCUMENTS

| | | | | |
|---|---|---|---|---|
| 1,441,251 | A * | 1/1923 | Steffens | 2/161.6 |
| 1,596,158 | A * | 8/1926 | Dempsey | 2/162 |
| 2,877,465 | A | 3/1959 | Stroud | |
| 4,698,851 | A | 10/1987 | Dunford et al. | |
| 4,793,005 | A | 12/1988 | Hetzel, Jr. | |
| 4,807,876 | A | 2/1989 | Lothar | |
| 5,133,233 | A | 7/1992 | Erwin | |
| D351,933 | S | 11/1994 | Stoneman | |
| 5,471,681 | A | 12/1995 | Ferrini | |
| 5,557,806 | A | 9/1996 | Caswell et al. | |
| 5,634,213 | A | 6/1997 | Grover | |
| 5,956,764 | A * | 9/1999 | Sabin | 2/69 |
| 5,988,681 | A | 11/1999 | Vesalainen et al. | |
| 6,038,743 | A | 3/2000 | Chapman | |
| 6,708,582 | B1 * | 3/2004 | McJunkin et al. | 2/161.1 |
| 2003/0154538 | A1 | 8/2003 | Murphy | |

* cited by examiner

*Primary Examiner*—John J. Calvert
*Assistant Examiner*—Richale L. Haney
(74) *Attorney, Agent, or Firm*—Jacobson Holman PLLC

(57) ABSTRACT

A cycling glove having a hand portion and a sleeve portion that incorporates an integrated latching mechanism situated just above the wrist and underneath the forearm. This latching mechanism has a housing fitted with a pivoting clamp element which, when the rider leans foward to bring the latching mechanism into engagement with the bar, partially encircles the handlebar and rotates with spring loading to provide, in combination with the housing, a clamping connection with the handlebar. To "click off" the handlebar, the rider simply withdraws one arm at a time, releasing the pressure on the clamping element which allows it to return to its at-rest position. The mounting surface of the handlebar is preferably provided with a thin handlebar sleeve for protection from abrasion arising as a result of repeated engagement and disengagement of the latching mechanism.

20 Claims, 4 Drawing Sheets

SLEEVED GLOVE WITH LATCHING MECHANISM FOR AERODYNAMIC POSITION WHEN CYCLING

BACKGROUND OF THE INVENTION

1. Field of the Invention

The present invention is related to the field of cycling and, more particularly, to a sleeved glove having an integrated latching mechanism for removable attachment to the handlebar of a bicycle.

2. Description of the Related Art

Whether in casual touring or during a road race or a lengthy cross country ride such as a Century event, the overall time required to cover the prescribed distance depends upon many factors in addition to basic rider conditioning. One important factor is wind resistance and the adoption of a body position that minimizes the same.

A cyclist's elapsed time in completing a race or ride will be largely influenced by the percentage of time during which he or she can maintain an aerodynamic tuck position that not only reduces wind resistance but also increases speed while conserving energy. This tuck position allows the rider to lean forward onto the forearms and "spin", which is a technique of applying a cadence to the pedals that advanced riders and all racers constantly work on and practice in order to improve their biking performance. As may be observed when watching professional bike racing, it is important for the teams not only to apply the principles of aerodynamics when working as a team but also to practice good individual body positioning during a race in order to ensure energy conservation and produce maximum performance from themselves and their equipment.

One way of producing maximum performance from cycling equipment is to invest much time and money in the engineering of equipment that is lighter and stronger. Thousands of dollars are spent to produce bicycle frames that are extremely light in weight. Everything that is thereafter bolted to the frame, e.g., wheels, handlebar and stem, gears, brakes, etc., must also be comparably lightweight and strong. Serious riders may spend thousands of dollars for a bike and then, over a period of time, spend hundreds more on accessories and replacement parts that are still lighter and stronger.

One such accessory may take the form of any number of aerodynamic bars that are currently on the market and in use. Such bars, which come in various shapes and configurations, may replace the existing handlebar, whether a conventional "10-speed" road style handlebar or other mountain bike or hybrid style bar, or may bolt directly to the existing handlebar, typically extending forward like an extra appendage hanging out over the front wheel. These bars are often provided with arm rests at the appropriate location to support the rider when he or she is leaning on the forearms. While such aerodynamic bars do allow the rider to attain an aerodynamic position, they are expensive, often unsightly and add additional weight so as to create an undesirable cost-benefit trade-off for the competitive cyclist. They can also make it difficult for inexperienced riders to use the bicycle when it has been modified in this way.

Accordingly, a need exists for a means of allowing the cyclist to comfortably adopt and maintain an aerodynamic tuck position for extended periods while cycling, without added weight or cumbersome structure that detracts from the balance and appearance of the bicycle.

SUMMARY OF THE INVENTION

In view of the foregoing, one object of the present invention is to overcome the difficulties of attaining an aerodynamic position on a bicycle having any one of a number of conventional road style handlebars.

Another object of the present invention is to provide a device that can be worn like a typical riding glove but which includes a sleeve portion having a latching mechanism for attachment to the handlebar.

A further object of the present invention is to provide a sleeved glove with latching mechanism that affirmatively engages the handlebar when the rider's weight is forward but which instantly releases in response to rearward or upward movement of the rider's arm.

A still further object of the present invention is to provide a mechanism that fully supports aerodynamic positioning of the rider when desired, while retaining full use of the conventional handlebar for ease of casual upright riding positions.

Yet another object of the present invention is to provide a portable device for adapting any bicycle to support aerodynamic positioning without adding any appreciable weight or noticeable structure to the bike.

In accordance with this and other objects, the present invention is directed to a glove having a hand portion of the kind all riders usually wear to protect their hands while riding, but which includes a sleeve portion that incorporates a latching mechanism that is situated just above the wrist and underneath the forearm. This latching mechanism has a housing with a semicylindrical channel fitted with a cooperating clamping element which, when the rider leans foward to bring the latching mechanism into engagement with the bar, partially encircles the handlebar of the bike and rotates to provide a clamping connection therewith. As long as the rider's weight is forwardly and downwardly directed onto the handlebar, the latching mechanisms, one on each arm, remain fully engaged with the handlebar, providing full control of the bicycle and also a very secure rest for the forearms. To "click off" the handlebar, the rider simply withdraws one arm at a time, releasing the clamping element and housing channel from their engagement with the bar and allowing the rider free use of that gloved hand for alternative grasping of the handlebar, access to a water bottle, etc. The mounting surface of the handlebar is preferably provided with a thin handlebar sleeve for protection from abrasion arising as a result of repeated engagement and disengagement of the latching mechanism.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
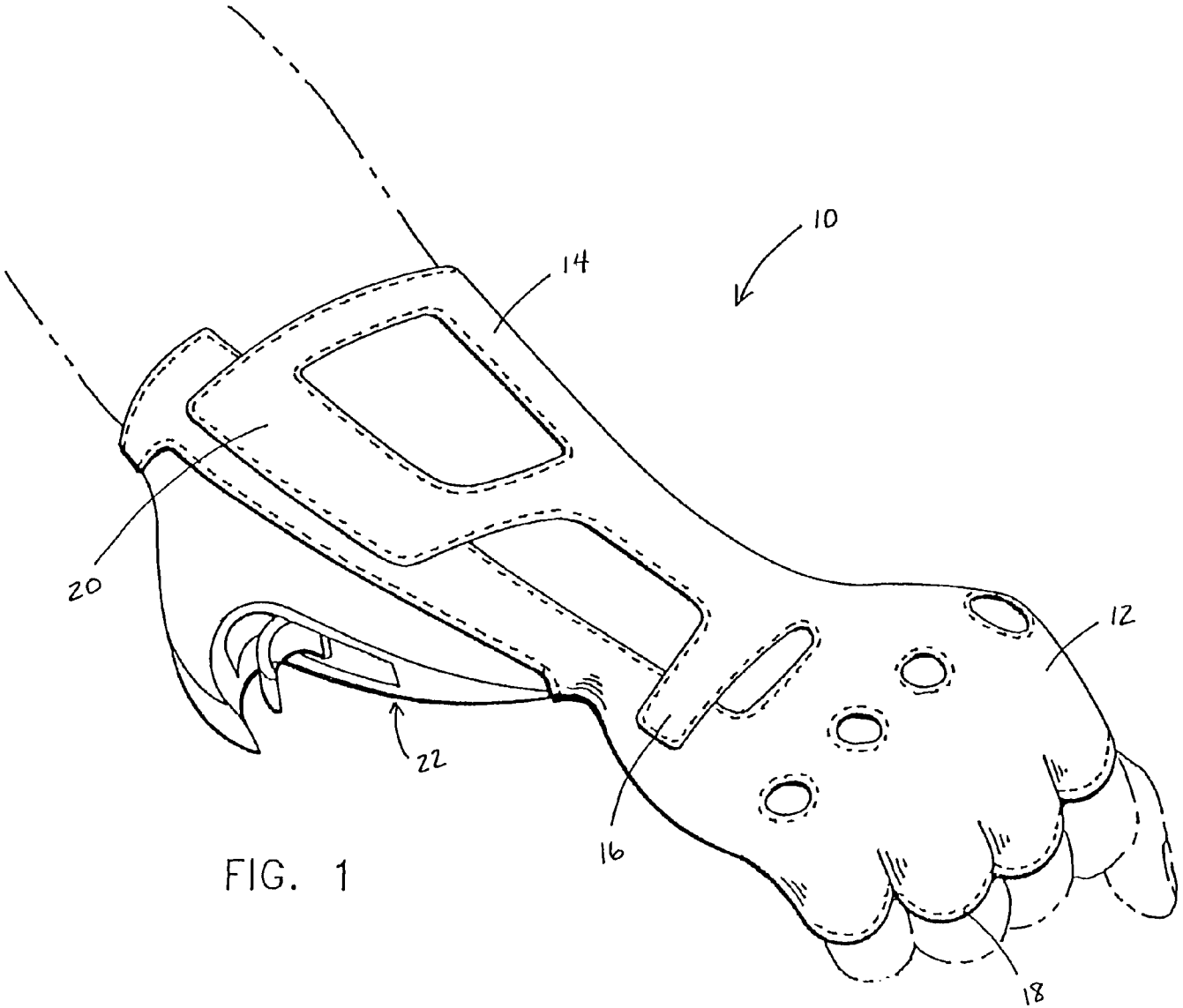
FIG. 1 is a concept drawing of a sleeved glove for aerodynamic cycling position in accordance with a preferred embodiment of the present invention.
Figure 2:
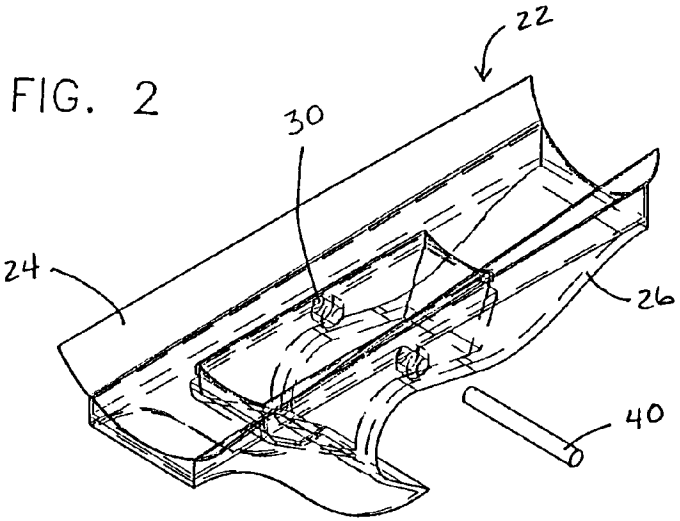
FIG. 2 is a perspective view of the housing/platform assembly and latching mechanism of the sleeved glove, showing a pivot pin in exploded view, in accordance with the present invention.
Figure 3:
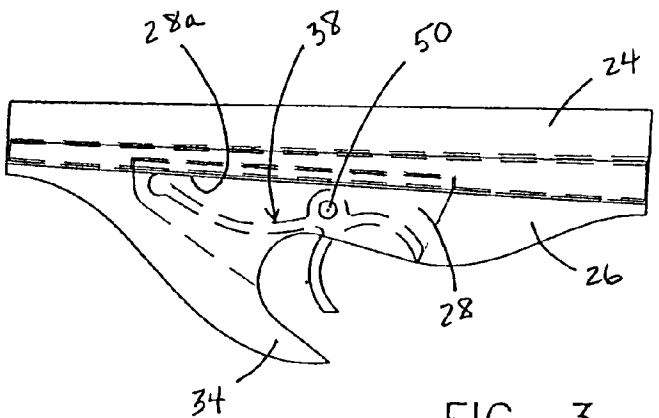
FIG. 3 is a side view of the housing/platform assembly and latching mechanism of FIG. 2.
Figure 4:
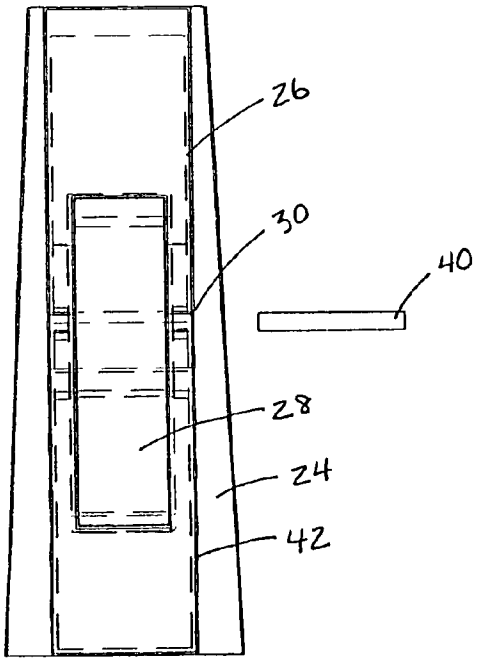
FIG. 4 is a top view of the housing/platform assembly, latching mechanism and pin of FIG. 2.
Figure 5:
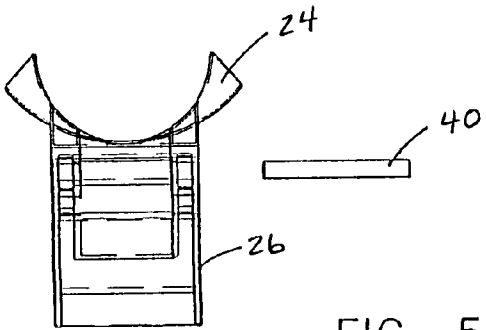
FIG. 5 is an end view of the housing/platform assembly, latching mechanism and pin of FIG. 2.
Figure 7:
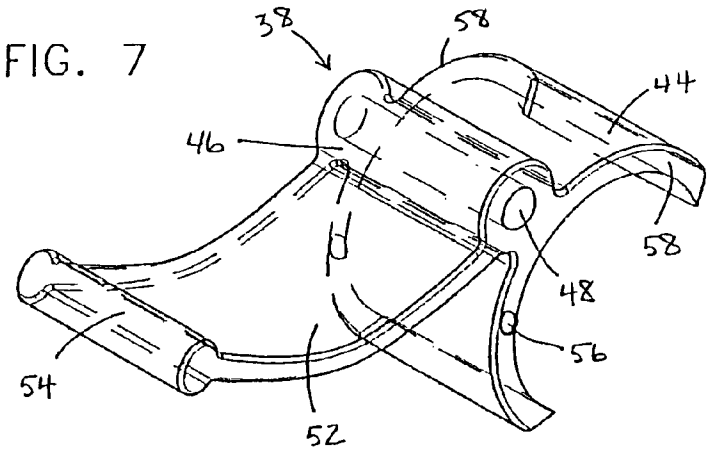
FIG. 7 is a perspective view of the latching mechanism of FIG. 2.
Figure 8A:
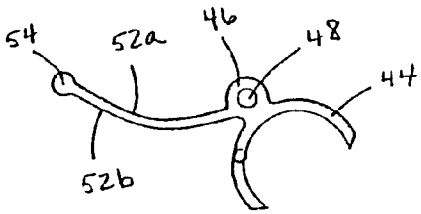
FIG. 8A is a side view of the latching mechanism of FIG. 7.
Figure 8C:
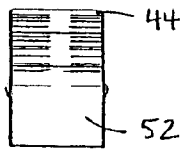
FIG. 8C is an end view of the latching mechanism of FIG. 7.
Figure 8B:
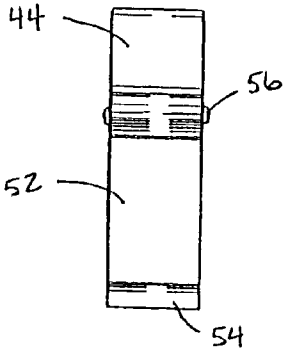
FIG. 8B is a top view of the latching mechanism of FIG. 7.
Figure 6:
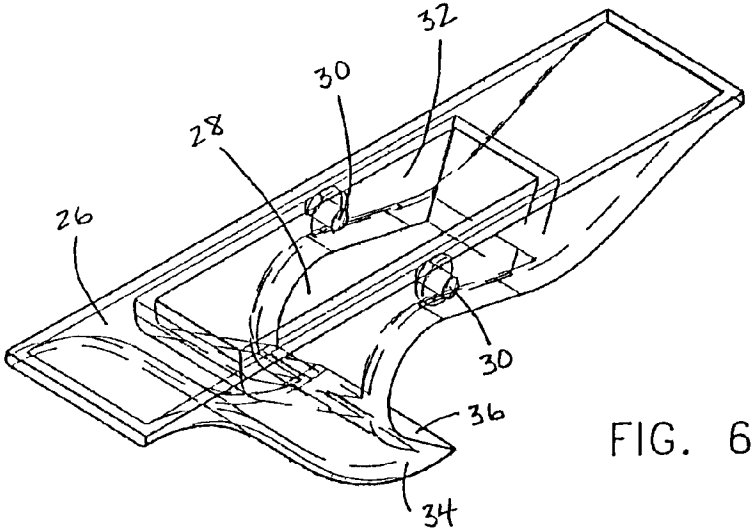
FIG. 6 is a perspective view of the housing of FIG. 2.

Although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

As shown in FIG. 1, the present invention is directed to a sleeved glove, generally designated by the reference numeral 10, which includes a fabric glove 12 and a sleeve portion 14. Being worn like a conventional glove, the glove 12 utilizes conventional cycling glove sewn construction with a padded palm area (not shown), wrist fastening element 16 and finger covering portion 18. The finger covering portion 18 may be embodied for partial covering so as to have open fingertips, as shown in FIG. 1, or a full-fingered glove may be used for cooler weather conditions or when greater protection of the fingers is desired.

The sleeve portion 14 extends to the mid-forearm and includes a forearm fastening element 20 such as a hook and loop type fastener that may be adjusted to fit snugly with infinitely variable sizing. Any other suitable fastening element may also be used. For purposes of description herein, the front or forward portion of the sleeved glove is defined as that which corresponds with the finger covering portion 18, while the rear portion is that closest to the wearer's elbow.

Coupled to the bottom of the sleeve portion 14 is a mounting surface embodied as a platform/housing assembly, generally designated by the reference numeral 22. As shown in FIGS. 2–6, the platform/housing assembly 22 includes a thin membrane portion or platform 24 which is an integrated structural part of the housing 26. The membrane may be made of any semi-flexible or flexible material such as plastic and is preferably sewn to the sleeve portion 14. The platform/housing assembly 22 provides for load distribution along the bottom of the rider's forearm, improving the long-term comfort of the sleeved glove 10 and aiding in steering stability.

The housing 26 has a recessed area or cavity 28 on an underside thereof which is provided with a pair of cylindrical apertures 30 in opposing side surfaces 32. The housing is also preferably provided with a projecting portion, such as a downwardly and forwardly extending hook portion 34, that defines an open generally semi-cylindrical channel 36. This channel 36 receives the handlebar when the sleeved glove is brought into the engaged position.

Fitted within the cavity 28 of the housing 26 is a latching mechanism, generally designated by the reference numeral 38. The latching mechanism is rotatably coupled to the housing 26 by a pivot pin 40, the ends of which pin are secured within the cylindrical apertures 30 of the housing. The lower edge of the side surfaces 32 is preferably provided with a raised portion or lip 42 to interact with the latching mechanism 38 when the sleeved glove is engaged with the handlebar, as will be more fully explained hereinafter.

The latching mechanism 38, shown in more detail in FIGS. 7, 8A, 8B and 8C, includes a generally semi-cylindrical C-clamp portion 44 having an axially extending rib 46 with a through-passing aperture 48 therein defining a pivot axis 50. The pin 40 extends through this aperture 48 and, with the ends thereof secured in the apertures 30, allows the latching mechanism to pivot about the pivot axis 50, as limited by the dimensions of the cavity 28 and the hook portion 34 that defines the channel 36. The upper surface 28*a* of the cavity is generally rectangular, with the axially extending rib 46 having sufficient room to rotate freely below such upper surface 28*a*, and with the side walls 32 preferably being generally perpendicular thereto.

Extending from the C-clamp portion 44 is a curved arm 52 having generally flat and substantially parallel upper and lower surfaces 52*a*, 52*b* terminating in a cylindrical abutment portion 54 at the distal end. The abutment portion 54 contacts the rearward area of the upper surface 28*a* of the housing cavity 28 and is generally parallel with the axially extending rib 46. The curvature of the arm 52 allows for a spring-like flexing action when the C-clamp portion 44 is rotated around the handlebar upon engagement therewith, as will be more fully set forth hereinafter.

A dimple 56 is provided on each of the outer side surfaces 58 of the C-clamp portion 44. These dimples 56 act as detents, providing a positive "clicking in" of the latching mechanism 38 in conjunction with the lip 42 of the housing 26 when the sleeved glove 10 is engaged with the bicycle handlebar and the clamp portion is rotated rearwardly.

Figure 9:
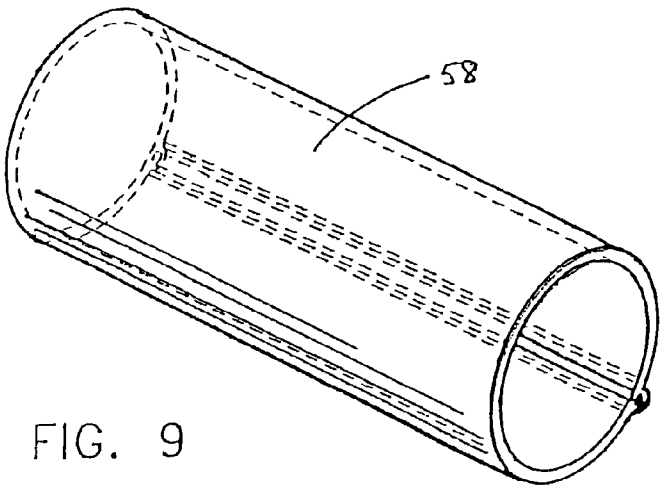
FIG. 9 is a perspective view of a handlebar sleeve for mounting on the handlebar and engaging with the latching mechanism in accordance with the present invention.

To protect the handlebar from scuffing and general abrasion arising from repeated contact with the hook portion 34 and corresponding channel 36 of the housing, a handlebar sleeve 58 such as that shown in FIG. 9 is fitted to the handlebar. The handlebar sleeve 58 provides proper tolerances for the latch mechanism 38, while being available with various internal diameter sizes to fit the particular handlebar being used. By selecting the proper-sized handlebar sleeve 58, the sleeved glove 10 according to the present invention can clip to any conventional road style handlebar top tube and, if desired, may also be used with any of the variant styles, sizes and diameters of handlebars on the market, either currently or in the future, provided a suitable, generally horizontal, top-tube orientation is available.

When not in use, the handlebar sleeve 58 can be easily removed if desired, being readily installed, removed and reinstalled without damage to either the sleeve 58 or the handlebar. The handlebar sleeve 58 is preferably constructed of a material that provides high tolerance control, self-lubricating features and extended wear properties, such as, but not limited to, plastics products including Kydex®, Nylon®, Delrin®, Teflon®, ABS (acrylic butarate styrene), etc.

FIGS. 10–13 depict various views of the sleeved glove 10 and handlebar sleeve 58 as mounted on a handlebar 60.

Figure 10:
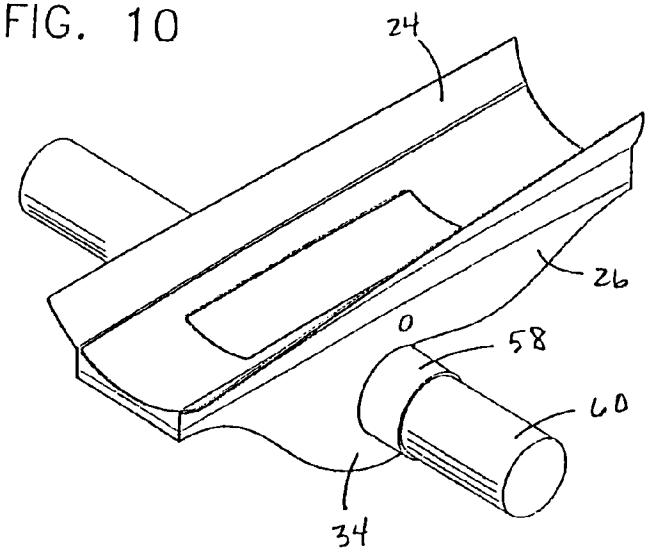
FIG. 10 is a perspective view of the housing/platform assembly with latching mechanism as mounted to a handlebar on the handlebar sleeve of FIG. 9, in accordance with the present invention.
Figure 11:
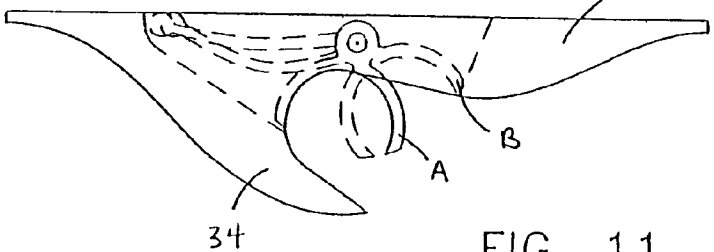
FIG. 11 is a side view of the housing/platform assembly with latching mechanism mounted on the handlebar sleeve, as shown in FIG. 10.
Figure 12:
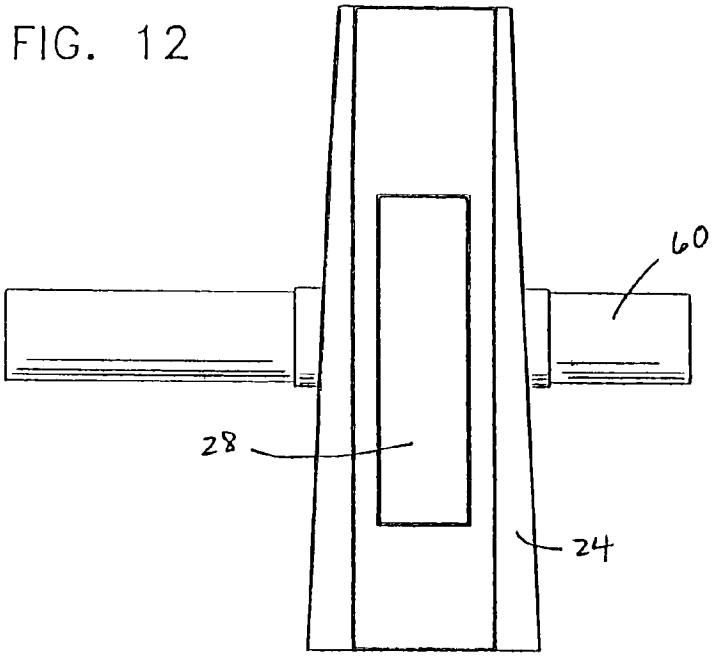
FIG. 12 is a top view of the housing/platform assembly with latching mechanism mounted on the handlebar sleeve, as shown in FIG. 10.
Figure 13:
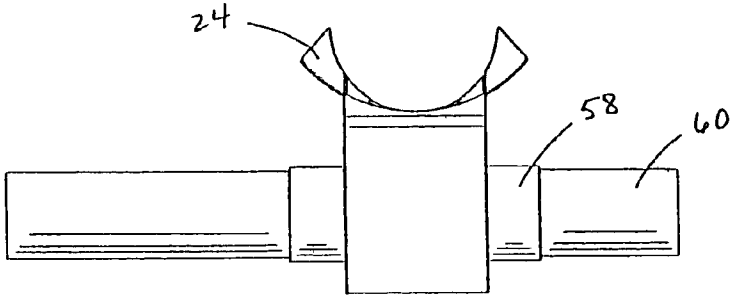
FIG. 13 is an end view of the housing/platform assembly with latching mechanism mounted on the handlebar sleeve, as shown in FIG. 10.

In use, when the latching mechanism is adjacent the sleeve 58 and handlebar 60 for engagement therewith, the latch mechanism pivots on the pin 40 and captures the handlebar to assist in stabilizing the steering control using the sleeved glove 10. As best shown in FIGS. 10 and 11, during the motion of capturing the handlebar, the clamp portion 44 of the latching mechanism 38 is rotated rearwardly around the handlebar 60 to preload the latching mechanism in preparation for release of the clamp portion when the rider's weight or pressure is removed from the horizontal tube of the handlebar. The rotation of the latching mechanism 38 also brings the projecting portion 34 of the housing 26 into positive contact with the handlebar so that the bar 60 is held between the C-clamp and the hook portion 34 to better secure and locate the sleeved glove 10 thereon when in the engaged position "A", as shown in FIG. 11.

To disengage the sleeved glove 10, which is done one glove at a time for safety in bicycle handling, the rider simply lifts one forearm away from the handlebar 60, while continuing to ride with the other forearm sleeved glove 10 in clamped engagement with the handlebar. The removal of the downward and forward pressure against the handlebar unloads the latching mechanism, allowing the preloaded leaf-spring-type force of the arm 52 to rotate the C-clamp 44 forwardly, back to its at-rest position "B", and thus disengaging the clamp from the handlebar. Once the rider's disengaged hand/arm has been relocated to a control position on the handlebar, the rider's other forearm with sleeved glove 10 can be similarly disengaged.

The arm 52 and C-clamp portion 44 are constructed of a material that will not only provide the latching mechanism 38 with sufficient strength to capture the handlebar, but which will also have the ability to flex and provide the desired spring-loading force to assist in disengagement of the clamp portion. Preferred materials include plastics products, such as, but not limited to, Kydex®, Nylon®, Delrin®, Teflon®, ABS (acrylic butarate styrene), etc. Similarly, the pin is constructed of a material that will suitably handle the loads and wear characteristics necessary for the latching mechanism as described herein, such as, but not limited to, steel, stainless steel, titanium, etc.

The present invention may also be embodied as a sleeve for use with a standard pair of cycling gloves, either with or without connection thereto. Such a sleeve may be embodied as a generally tubular piece of fabric material that is pulled on over the hand to grip the forearm. Adequate gripping of the forearm may be obtained either through the use of a fabric material of sufficient elasticity or, separately from or in addition to such elasticity, through the inclusion of one or more wrist and forearm fastening members. Separate wrist and forearm fastening members may be provided, such as are shown in FIG. 1, or the length of the sleeve may be provided with an extended fastening member.

As a further alternative, the sleeve may be embodied as a flat piece of fabric having a strip of loop fastening material on one longitudinal edge and a corresponding strip of hook fastening material on the opposite longitudinal edge. The fabric may be then be wrapped around the forearm, without being drawn over the hand, and the hook and loop fastening strips joined to secure the desired degree of tension on the arm. Other fastening means known in the art and appropriate for such use may also or alternatively be used.

Particularly in such sleeve-only embodiments, one or more stiffening elements may also be sewn into the length of the sleeve fabric to provide greater stability for the housing. While providing a supporting skeletal structure, such stiffening elements should be of sufficient flexibility to ensure wearer comfort.

As a further alternative embodiment, the sleeve may include a flexible stiffening element embodied as a band around the upper edge of the forearm to retain the positioning of the sleeve, either with or without further structural support from lengthwise stiffening elements. The fabric portion of such a sleeve may cover only the underside of the forearm to which the housing is secured, leaving the upper side of the forearm bare.

The precise construction and coverage of the sleeve portion may be varied in other ways, so long as the sleeve portion is provided with a suitable mounting surface for the securing and operation of the latching mechanism as the latter is herein described. Thus, in any of the alternative sleeve-only embodiments just described, the housing/platform assembly with latching mechanism is integrated into a mounting surface, e.g., a housing, in the underside of the sleeve in the same manner as was described in connection with the preferred sleeved-glove embodiment, with the manner of operation being the same as has already been disclosed.

While the preferred embodiments of the present invention utilize the rotating clamping mechanism as set forth herein, other latching mechanisms may also be used, falling within the intended scope of the present invention as directed to a sleeved glove worn by a cyclist and allowing for aerodynamic positioning on a bicycle without the need for specialized handlebar constructions. Accordingly, the latching mechanism may be alternatively embodied by a non-rotating clamping mechanism of variable shape, a ball and socket type of connecting apparatus, or a contact connection such as a hook and loop fastener, e.g., Velcro®, having good break-away characteristics.

As a further alternative, the handlebar sleeve could be provided with rails or runners that would provide a snap-on or slide-on type of connection with complementary structure mounted to the sleeve portion of the glove. Whether the sleeve and handlebar elements slide or snap into engagement with one another, the connection should be such as to allow the rider to pull out of the connection with an upward and/or rearward motion, whether or not the connecting elements are in the alignment that would be necessary for initial coupling thereof. In this way, the rider's safety is ensured. Other fastening structures having an operation such as that utilized in ski bindings or in clip-on pedals for cycling could be adapted to provide the needed engagement with the handlebar when the rider is aerodynamically positioned, while also allowing for ready disengagement with control of the bicycle being maintained.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A sleeved article for obtaining an aerodynamic position when cycling, comprising:

a sleeve portion extending from a wrist area at least partly up a wearer's forearm;

a mounting element coupled to said sleeve portion, said mounting element including a housing having a projecting portion that defines a generally semi-cylindrical channel configured to receive a bicycle handlebar; and a connecting mechanism mounted to said mounting element and configured to work cooperatively therewith to engage said bicycle handlebar.

2. The sleeved article as set forth in claim 1, wherein the sleeved article includes a fabric glove integrally formed with said sleeve portion.

3. The sleeved article as set forth in claim 1, wherein said connecting mechanism is pivotally mounted to said housing and includes a clamping element for positively engaging a bicycle handlebar when rotated toward said projecting portion in response to downwardly-directed pressure and for returning to a rest position and releasing said handlebar when said pressure is removed.

4. The sleeved article as set forth in claim 3, wherein said housing includes a recessed area, said connecting mechanism pivotally mounted within said recessed area.

5. The sleeved article as set forth in claim 4, wherein said clamping element includes a generally semicylindrical C-clamp portion having an axially extending rib with a through-passing aperture therein, a pivot pin extending through said aperture into said recessed area to provide a pivot axis for said clamping element.

6. The sleeved article as set forth in claim 5, wherein said clamping element further comprises a curved arm having an abutment portion contacting an upper surface of said recessed area to spring load the clamping element upon rotation thereof toward said projecting portion.

7. The sleeved article as set forth in claim 3, wherein said sleeve portion is made of fabric and said housing includes a platform sewn to the fabric sleeve portion and having a curvature for fitting the wearer's forearm.

8. The sleeved article as set forth in claim 1, wherein said connecting mechanism includes a clamping element having an at-rest position and an engaged position, rotation of said clamping element to said engaged position preloading the connecting mechanism to return to said at-rest position.

9. The sleeved article as set forth in claim 4, wherein said recessed area is a cavity having a generally rectangular upper surface and side surfaces that are generally perpendicular to said upper surface, ends of said pivot pin being secured within generally cylindrical apertures in said side surfaces.

10. A sleeved article for obtaining an aerodynamic position when cycling, comprising:

a fabric sleeve portion extending from a wrist area at least partly up a wearer's forearm;

a housing coupled to said sleeve portion, said housing having an open cavity on an underside thereof and a generally semi-cylindrical channel open on a side facing the wrist area; and a latching mechanism pivotally mounted in said cavity and having a clamping element for engaging a bicycle handlebar in conjunction with said channel.

11. The sleeved article as set forth in claim 10, wherein said clamping element includes a generally semicylindrical C-clamp portion having an axially extending rib with a through-passing aperture therein, a pivot pin extending through said aperture into inner walls of said cavity to provide a pivot axis for said clamping element.

12. The sleeved article as set forth in claim 11, wherein said clamping element further comprises a curved arm having an abutment portion contacting an upper surface of said cavity to spring load the latching mechanism upon rotation of the clamping element toward said channel.

13. The sleeved article as set forth in claim 10, wherein the sleeved article includes a glove integrally formed with said sleeve portion.

14. The sleeved article as set forth in claim 10, wherein said housing includes a platform sewn to the fabric sleeve portion and having a curvature for fitting the wearer's forearm.

15. A sleeved article for obtaining an aerodynamic position when cycling, comprising:

a fabric sleeve portion extending from a wrist area at least partly up a wearer's forearm;

a housing coupled to an underside of said sleeve portion, said housing having a hook portion extending toward said wrist area; and a latching mechanism pivotally mounted to said housing and having a clamping element for engaging a bicycle handlebar when rotated toward said hook portion.

16. The sleeved article as set forth in claim 15, wherein said clamping element includes a generally semicylindrical C-clamp portion having a through-passing aperture therein, a pivot pin extending through said aperture into said housing to provide a pivot axis for said clamping element.

17. The sleeved article as set forth in claim 16, wherein said clamping element further comprises a curved arm having an abutment portion to spring load the latching mechanism upon rotation of said clamping element upon rotation toward said hook portion.

18. The sleeved glove as set forth in claim 15, wherein said housing includes a cavity with said latching mechanism pivotally mounted therein.

19. The sleeved article as set forth in claim 16, wherein said housing includes a cavity having a generally rectangular upper surface and side surfaces that are generally perpendicular to said upper surface, ends of said pivot pin being secured within generally cylindrical apertures in said side surfaces.

20. The sleeved article as set forth in claim 15, wherein the sleeved article includes a glove integrally formed with said sleeve portion.

* * * * *